US005847681A

United States Patent [19]

Faherty et al.

[11] Patent Number: 5,847,681

[45] Date of Patent: Dec. 8, 1998

[54] COMMUNICATION AND TRACKING ANTENNA SYSTEMS FOR SATELLITES

[75] Inventors: William C. Faherty, El Segundo; Steven O. Lane, Torrance, both of Calif.

[73] Assignee: Hughes Electronics Corporation, Los Angeles, Calif.

[21] Appl. No.: 739,538

[22] Filed: Oct. 30, 1996

[51] Int. Cl.[6] ..... H01Q 21/00; H01Q 13/00

[52] U.S. Cl. ..... 343/725; 343/700 MS; 343/781 P; 343/756

[58] Field of Search ..... 343/725, 729, 343/781 P, 781 CA, 700 MS, 873, 756, 909, 786, DIG. 2

[56] References Cited

U.S. PATENT DOCUMENTS

| | | | |
|---|---|---|---|
| 4,575,726 | 3/1986 | Gounder | 343/756 |
| 4,625,214 | 11/1986 | Parekh | 343/756 |
| 4,665,405 | 5/1987 | Drabowitch et al. | 343/756 |
| 5,307,077 | 4/1994 | Branigan et al. | 343/725 |
| 5,402,137 | 3/1995 | Ramanujam et al. | 343/781 |
| 5,673,056 | 9/1997 | Ramanujam et al. | 343/756 |

OTHER PUBLICATIONS

James et al, "Superimposed dichroic microstrip antenna array", IEE Proceedings, vol. 135, Pt H, No. 5, Oct. 1988, pp. 304–312.

*Primary Examiner*—Don Wong
*Assistant Examiner*—Tan Ho
*Attorney, Agent, or Firm*—Georgann S. Grunebach; M. W. Sales

[57] ABSTRACT

A communication and tracking antenna is formed by embedding a tracking patch array in a shaped dual gridded reflector. The reflector includes first and second reflector grids that have orthogonally arranged grid lines and are respectively fed by feed horns. The patch array is positioned so that the first reflector grid is between the patch array and the first feed horn. The first reflector grid thus serves as a filter to remove unwanted polarization components and enhance the quality of both the tracking radiation and the radiation that is reflected from the second reflector grid. In other embodiments, a tracking array is positioned adjacent a reflector's perimeter.

36 Claims, 8 Drawing Sheets

COMMUNICATION AND TRACKING ANTENNA SYSTEMS FOR SATELLITES

BACKGROUND OF THE INVENTION

1. Field of the Invention

The present invention relates generally to microwave antennas.

2. Description of the Related Art

A conventional microwave antenna 20 for a satellite communication system is shown in FIG. 1A. The antenna 20 includes a dual gridded reflector 22 and first and second sets of microwave feed horns 24 and 26. The dual gridded reflector 22 is configured to generally have the form of a parabola (indicated by broken-line extension 27 of the dual gridded reflector 22) which has a focal axis 28 and a reflector focus 29 on the focal axis 28. The feed horn sets 24 and 26 are positioned in the region of the reflector focus 29 and are arranged to direct microwave energy at the dual gridded reflector 22.

The dual gridded reflector 22 has first and second reflector grids 30 and 32 which are respectively shown in FIGS. 1B and 1C. Each reflector grid is made up of a plurality of parallel, reflective grid lines 34. Exemplary grid lines are formed by printing spaced copper lines on a polymer sheet. The reflector grids 30 and 32 are spaced apart and their grid lines are arranged in a mutually orthogonal relationship. Although the reflector 22 is generally parabolic, it is shown as a simple section in FIG. 1A for simplicity of illustration. More accurately, its near and far sides typically curve inward as indicated by the partial broken line 33. Although the first and second reflector grids 30 and 32 of FIGS. 1B and 1C are shown with an exemplary circular configuration, other configurations are useful, e.g., elliptical or rectangular.

The first feed horn set 24 is configured to radiate microwave energy 40 with a polarization (i.e., electric field orientation) that is aligned with the reflector grid 30. Similarly, the second feed horn set 26 is configured to radiate microwave energy 42 with a polarization that is aligned with the reflector grid 32 (although the microwave energy illuminates the entire dual gridded reflector 22, the microwave energies 40 and 42 are represented by a single line and are shown to only radiate from an exemplary feed horn of each feed horn set 24 and 26 for clarity of illustration).

The spacing of the grids 34 of the first reflector grid 30 is sufficiently small to cause the grids to reflect the incident microwave energy 40 whose electric field is polarized in parallel with the grids of this reflector grid. Because the first reflector grid 30 is orthogonal to the electric field of the microwave energy 42, it is substantially transparent to this energy. Similarly, the spacing of the grids 34 of the second reflector grid 32 is sufficiently small to cause the grids to reflect the incident microwave energy 42 whose electric field is polarized in parallel with the grids of this reflector grid. Thus, the microwave radiations 40 and 42 are reflected respectively from the reflector grids 30 and 32.

The feed horn polarization can be realized with a variety of conventional feed horns. For example, FIG. 1D shows an E-plane sectoral horn 50 which has a rectangular waveguide section 51 that is coupled to a flared horn section 52. The rectangular section 51 has broad sides 53 and narrow sides 54 which terminate in an input 55. The narrow sides 54 flare outward to an output 56 which terminates the flared horn section 52. If microwave energy is inserted into the input 55 with its electric field 57 orthogonal to the broad sides 53, it will be radiated from the output 56 with its electric field (and, hence, its polarization) still orthogonal to the broad sides 53.

In an exemplary satellite communication system, a satellite carrying the antenna 20 is stationed in a geostationary orbit and the antenna 20 is configured and positioned to illuminate a predetermined portion of the Earth's surface (this portion is conventionally referred to as the radiation's "footprint" on the Earth's surface).

Radiation from a feed horn which is positioned at the reflector focus 29 in FIG. 1A will be reflected from the dual gridded reflector 22 as collimated energy that is parallel with the parabolic axis 28 (although it is assumed in this description, for simplicity, that the focus of each reflector grid is at the general reflector focus 29, their foci are actually spaced apart just as are the grids). However, the footprint due to each feed horn can be modified by displacing the position of that feed horn from the reflector focus 29 to vary the phasing of the reflected radiation. The individual footprints associated with each feed horn in the feed horn set 24 can be selected in this manner so that, in total, they form a predetermined combined footprint. Similarly, the individual footprints of the feed horns in the feed horn set 26 can be selected so that they also form a predetermined combined footprint.

For example, FIG. 2 shows a view of the Earth 60 with its equator 61. A combined footprint 62 is formed by a plurality of individual footprints 64. The combined footprint 62 covers the continental United States of America and is accordingly referred to as a contiguous United States footprint (often shortened to the acronym CONUS). The individual footprints 64 are formed by the radiation of the feed horn set 24 and the reflector grid 30 (for clarity of illustration, only exemplary individual footprints 64 are shown). A similar combined footprint would be formed by the feed horn set 26 and the reflector grid 32. By generating footprints with different polarizations, the antenna 20 can increase the number of its communication channels for a predetermined bandwidth. For example, any selected pair of feed horns from the feed horn sets 24 and 26 can radiate signals which have the same microwave frequency because orthogonally polarized signals can be selectively received by receivers on the Earth.

To generate the combined footprint 62, the orientation of the antenna 20 must be maintained relative to the Earth 60. This orientation is generally realized by tracking a tracking station which is located within the combined footprint, e.g., the station 73 that is indicated by a cross in FIG. 2. Accordingly, the antenna 20 of FIG. 1A also includes a set of tracking feed horns which are arranged as an array 72 of radiating (or receiving) elements and are positioned in the region of the reflector focus 29. This array of feed horns is combined with a tracking transmission structure 74 to form a conventional tracking feed 70 as shown in FIG. 3A. The tracking transmission structure 74 couples microwave energy to feed horns 75, 76, 77 and 78 of the feed horn array 72. The outputs of the feed horns 75, 76, 77 and 78 are arranged to form the array 72 as shown in FIG. 3B. For clarity of description, the outputs are also labeled respectively as A, B, C and D.

The tracking transmission structure 74 includes microwave hybrids 80, 81, 82 and 83. A typical microwave hybrid has two input ports and two output ports and is constructed so that an input signal at a first input is divided into two signals at the outputs which are equal in magnitude and phase while an input signal at a second input is divided into two signals at the outputs which are equal in magnitude and opposite in phase.

For example, a signal at port 86 of hybrid 80 will appear as two equal magnitude signals at outputs 87 and 88 and the phase of these signals will differ by 90°. The tracking transmission structure 74 also includes a plurality of 90° phase shifters 90. Ports 86 and 94 of the hybrid 80 are typically referred to respectively as delta elevation (ΔΣl) and sum (Σ) inputs and port 96 of the hybrid 81 is typically referred to as the delta azimuth (ΔAz) input. Input port 98 of the hybrid 81 is terminated with a load 99.

The tracking feed 70 is combined with a selected one of the reflector grids 30 and 32 of FIG. 1A to form a tracking antenna. The division and phasing of signals in the transmission structure 74 is such that a microwave signal at the port 86 generates a tracking signal of (A+B)−(C+D) from the feed horns of FIG. 3B. A microwave signal at the port 94 generates a tracking signal of (A+B+C+D) and a microwave signal at the port 96 generates a tracking signal of (B+D)−(A+C). These signals are reflected from the selected reflector grid and the resulting radiation patterns are respectively shown in FIGS. 4A, 4B and 4C.

The delta elevation radiation pattern 100 has sub-patterns 101 and 102 which each rise to maximum contours 103. The sub-patterns 101 and 102 are positioned above and below a null region 104. Because of the phasing of the tracking transmission structure 74, the phases of the sub-patterns 101 and 102 differ by 180° and this phasing switches through the null 104. Thus, the delta elevation radiation pattern 100 provides a signal which indicates the elevation pointing error of the tracking antenna 70 relative to a tracking station (e.g., the station 73 which is centered upon the pattern 100). The delta azimuth radiation pattern 110 is similar to the delta elevation pattern 100 except that it is rotated 90°. This pattern indicates the azimuth pointing error of the tracking antenna 70 relative to a tracking station.

The delta elevation and delta azimuth radiation patterns 100 and 110 provide the signals required for use in a feedback control system which steers the antenna 20 of FIGS. 1A–1D. The sum pattern 115 of FIG. 4B has a concentric radiation pattern which rises to a maximum contour 116 at its center. The sum pattern thus provides a strong signal at the tracking station when the tracking antenna radiation patterns are centered over the tracking station.

As mentioned above, the tracking feed 70 of FIG. 3A is combined with a selected one of the reflector grids 30 and 32 of FIG. 1A to form a tracking antenna. Accordingly, the tracking feed horn array 72 is configured and arranged so that its polarization is aligned with the grid lines 34 of the selected reflector grid.

Although the antenna patterns of FIGS. 4A–4C have been described (for convenience of description) from the operational viewpoint of transmitting, the same patterns apply to the following receiving operation because of the reciprocity property of antennas.

In an exemplary operation, an earthbound tracking station (73 in FIG. 2) transmits a tracking signal. This tracking signal is received by the tracking antenna (the tracking feed 70 of FIG. 3A and a selected one of the reflector grids 30 and 32 of FIG. 1A). This transmitted signal is received by the tracking antenna in accordance with the delta elevation, sum and delta azimuth radiation patterns of FIGS. 4A–4C. This reception generates tracking control signals at the ports 86, 94 and 96 (in the tracking feed 70 of FIG. 3A) which facilitate steering of the antenna 20 (e.g., the control signals are used in a feedback control system).

The number of feed horns which are required in each of the feed horn sets 30 and 32 to generate a complex footprint such as the CONUS footprint 62 of FIG. 2 can be quite large (e.g., in the range of 20–40). Accordingly, the structural realization of the antenna 20 of FIGS. 1A–1D is undesirably heavy and large, especially when it is used in a satellite application.

Another conventional microwave antenna 120 is shown in FIG. 5A. The antenna 120 is similar to the antenna 20, with like elements indicated by like reference numbers. However, the dual gridded reflector 22 of the antenna 20 is replaced by a shaped dual gridded reflector 122. Also, the feed horn sets 24 and 26 are replaced by individual feed horns 124 and 126 which are positioned close to the reflector focus 29.

The dual gridded reflector 122 has first and second reflector grids 130 and 132 which are respectively shown in FIGS. 5B and 5C. Similar to the antenna 20, the reflector grids are made up of a plurality of parallel, reflective grid lines 134. The reflector grids 130 and 132 are arranged in a mutually orthogonal relationship and microwave energies 140 and 142 from the feed horns 124 and 126 are reflected respectively from the reflector grids 130 and 132.

Although it has a generally parabolic form, the dual gridded reflector 122 (and its reflector grids 130 and 132) is reshaped to have dimensional deviations which generate phase variations in the microwave radiations 140 and 142 as they are respectively reflected from the reflector grids 130 and 132 (for clarity of illustration, this reshaping is represented by coarse ripples in the reflector grids). This phase variation generates a predetermined footprint, e.g., the CONUS footprint 62 of FIG. 2, from the radiation of each of the feed horns 124 and 126. Methods for generating the shaped surfaces of shaped dual gridded reflectors are well known in the antenna art, e.g., as described in U.S. Pat. No. 5,402,137 to Ramanujam, Parthasarathy, et al. which issued Mar. 28, 1995 and was assigned to Hughes Electronics, the assignee of the present invention.

In contrast to the feed horn sets 24 and 26 of the antenna 20 of FIGS. 1A–1D, the antenna 120 of FIGS. 1A–1C requires only a pair of feed horns 124 and 126. Although this significantly reduces its size, weight and complexity, the antenna 120 still requires a tracking feed, e.g., the tracking feed 70 of FIG. 3A, with its attendant array 72 of tracking feed horns. In addition, the phase variations which are introduced by the shaped surface of the dual gridded reflector 122 cause the design of the tracking feed to become complex and time consuming and, therefore, expensive.

SUMMARY OF THE INVENTION

The present invention is directed to a simple, lightweight and easily realized antenna system which is especially suitable for communication and tracking applications, e.g., in a geosynchronous satellite. This goal is achieved with the recognition that a compact patch array can function as a tracking antenna and can be embedded in a shaped dual gridded reflector of a communication antenna in a manner which will cause little if any degradation of that antenna's performance.

In one embodiment, the antenna system has first and second feed horns, a dual gridded reflector which includes first and second reflector grids that are arranged in a mutually orthogonal relationship, and a patch array. The first and second feed horns are configured to radiate microwave energy with polarizations that are aligned respectively with the first and second reflector grids. The dual gridded reflector is positioned to reflect microwave energy from the first and second feed horns with the first reflector grid positioned between the second reflector grid and the first and second feed horns.

The patch array is positioned so that the first reflector grid is between the patch array and the first and second feed horns, and the patch array is configured to radiate (or receive) microwave energy through the first reflector grid. Accordingly, the patch array is arranged to define patch quadrants and the antenna system preferably includes transmission line feeds which couple microwave energy into the patch quadrants with a polarization that is substantially aligned with the second reflector grid.

The first reflector grid shields the embedded patch array from the orthogonally polarized radiation of the first feed horn. The first reflector grid also filters any polarization components of the patch array's radiation which are aligned with the first reflector grid. The second reflector grid preferably defines windows and each of the patches is aligned with a respective one of the windows and the second feed horn.

Preferably, the patch array is coplanar with the windows so that the array contributes properly phased radiation to the radiation from the second reflector grid. To further reduce interference, the feed horns and patch array are configured to radiate microwave energy in mutually exclusive frequency bands.

When used in a satellite communication application, the dual gridded reflector is preferably configured to have the general form of an off-axis segment of a parabola and is shaped to have dimensional deviations that generate phase variations in the microwave radiation. The phase variations generate a predetermined footprint on the Earth's surface.

Other antenna systems are formed by positioning a tracking antenna adjacent or adjoining the perimeter of a communication antenna reflector. In this embodiment, the reflector may be solid or gridded.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 5C:
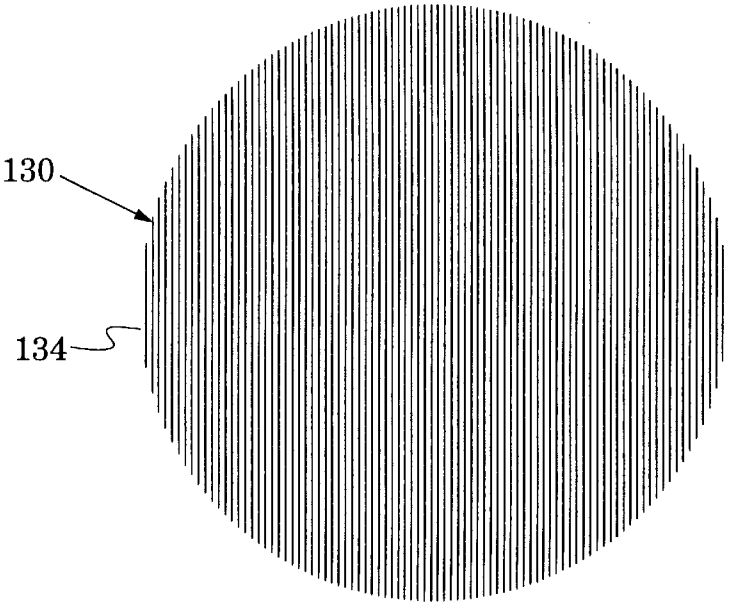
FIG. 5C (PRIOR ART)
FIG. 5C is a front view of the shaped dual-gridded reflector of FIG. 5A.
Figure 5B:
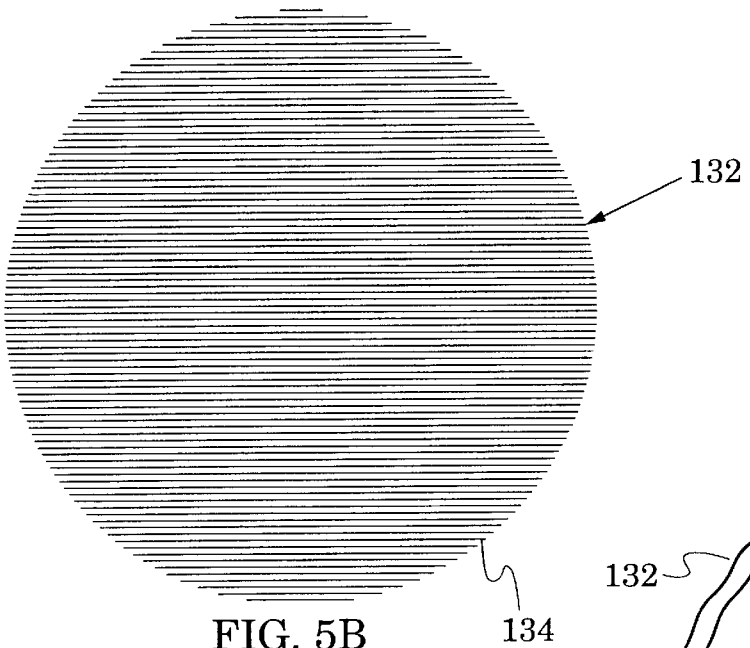
FIG. 5B (PRIOR ART)
FIG. 5B is a rear view of the shaped dual-gridded reflector of FIG. 5A.
Figure 5A:
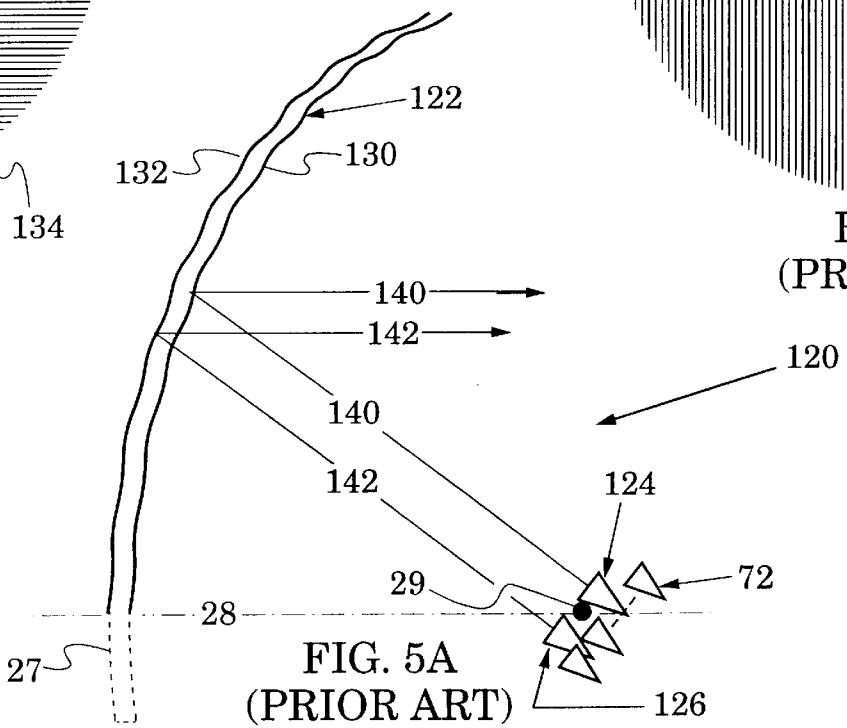
FIG. 5A (PRIOR ART)
FIG. 5A is a side view of a conventional communication antenna system which includes a shaped dual-gridded reflector, a pair of communication feed horns and a plurality of tracking feed horns.
Figure 6C:
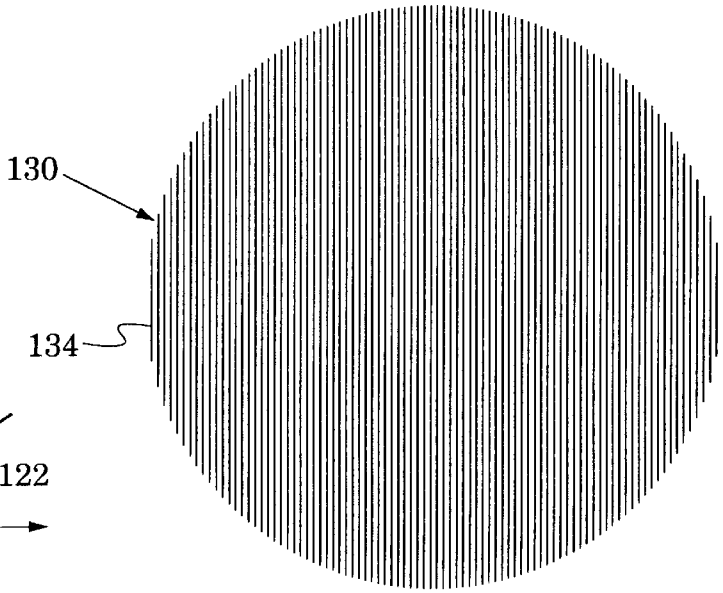
FIG. 6C is a front view of the shaped dual-gridded reflector of FIG. 5A.
Figure 6B:
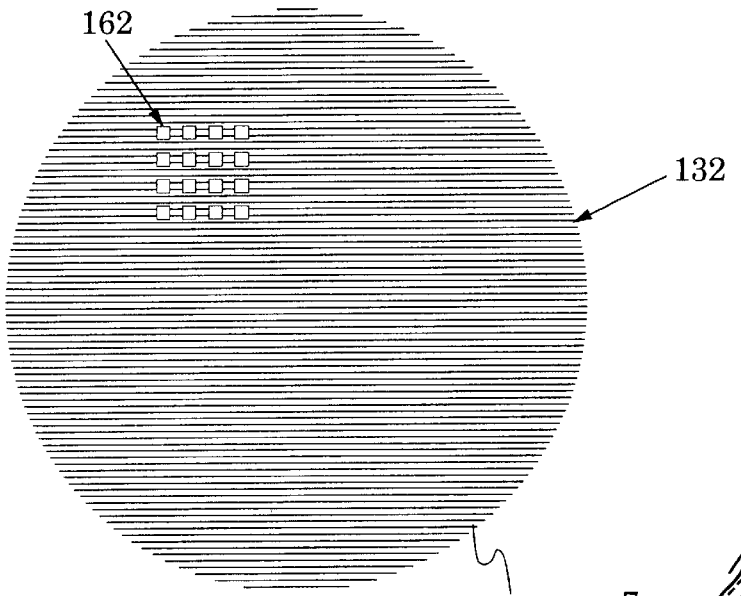
FIG. 6B is a rear view of the shaped dual-gridded reflector and patch array of FIG. 5A.
Figure 6A:
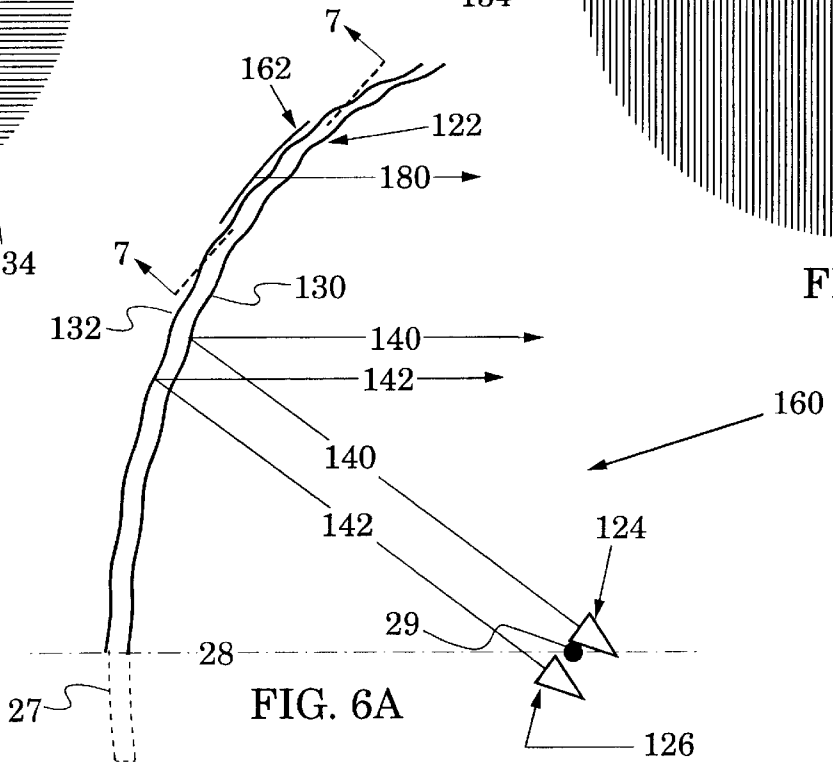
FIG. 6A is a side view of a communication antenna system in accordance with the present invention, which has a shaped dual-gridded reflector, a pair of communication feed horns and an embedded patch array.

An antenna system 160 in accordance with the present invention is shown in FIGS. 6A–6D. The antenna 160 is similar to the antenna 120 of FIGS. 5A–5C, with like elements indicated by like reference numbers. However, the tracking feed horn array 72 of FIG. 5A is replaced by a patch array 162 as shown in FIGS. 6A and 6B. The patch array 162 is positioned so that the first reflector grid 130 is between the patch array and the first and second feed horns 124 and 126.

Figure 6D:
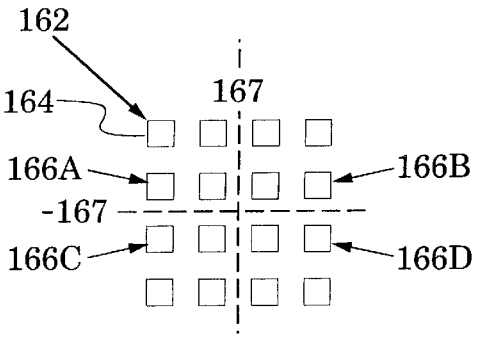
FIG. 6D is an enlarged view of the patch array of FIG. 6B.

The patch array 162 includes sixteen patches 164 which are arranged to facilitate their segmentation into four array quadrants 166A–166D as illustrated in the enlarged view of FIG. 6D. In this latter view, broken lines 167 are inserted to define the quadrants. Although they are shown to have a rectangular shape, other useful patch configurations, e.g., circular, can be employed.

Each of the array quadrants 166A–166D is configured to function as a separate radiator. Accordingly, they can be connected in a tracking feed similar to the tracking feed 70 of FIG. 3A. That is, a different tracking feed is formed by respectively substituting the array quadrants 166A–166D for the tracking feed horns 75–78 in FIG. 3A.

Figure 7:
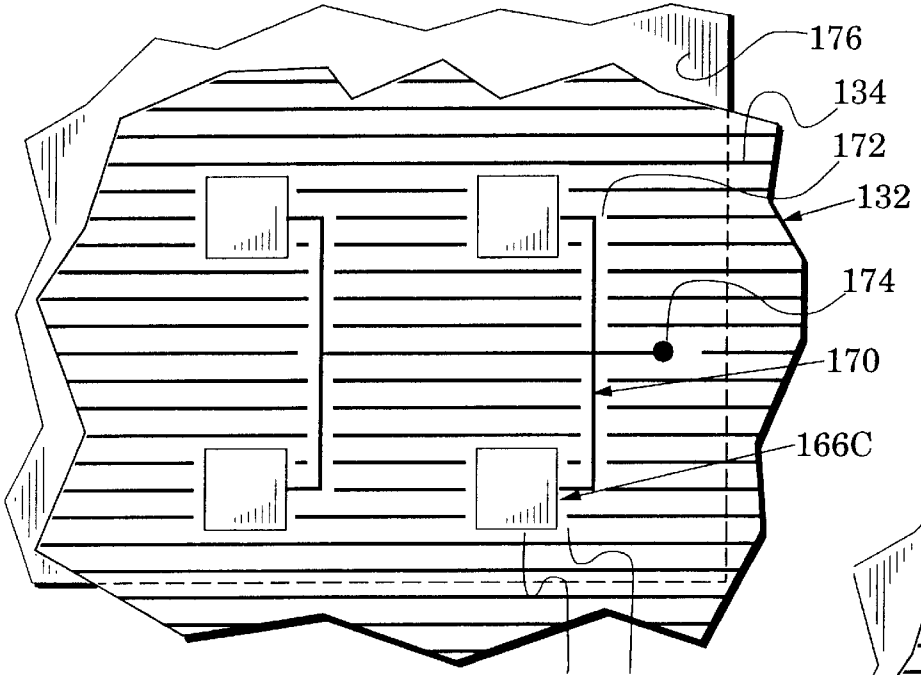
FIG. 7 is an enlarged view along the plane 7—7 of FIG. 6A, which shows a single quadrant of the patch array of FIG. 6A and a transmission line feed associated with that quadrant.

FIG. 7 is an enlarged view which illustrates an exemplary quadrant 166C. The grid lines 134 of the second reflector grid 132 are selectively broken to form a plurality of windows 168. Each of the windows 168 is positioned so that a respective one of the patches 164 is aligned with that window and the second feed horn 126. That is, each window 168 and its respective patch 164 are positioned so that the patch "sees" the second feed horn 126.

A transmission line feed 170 couples to each of the patches 164 of the patch quadrant 166C so that microwave energy can be coupled to or from the patch quadrant. The transmission line feed 170 is arranged to connect to a side of each patch 164 so that the polarization of the patch quadrant 166C is aligned with the second reflector grid 132. The reflector grid is selectively broken to form passages 172 through which the transmission line feed 170 passes. The transmission line feed 170 terminates in a termination 174 which facilitates connection to similar transmission line feeds of the other patch quadrants 166A, 166B and 166D.

A ground plane 176 is spaced rearward of the patch quadrant 166C. This ground plane extends below and to the right of the patch quadrant 166C so that there is a margin between the edges of the patch quadrant and the edges of the ground plane. Although not shown in this view, the ground plane 176 extends upward and to the left so as to form a ground plane behind the other patch quadrants 166A, 166B and 166D. In a similar manner, the ground plane extends sufficiently in these directions so that there is a margin between the edges of these patch quadrants and the edges of the ground plane 176. The ground plane 176 directs microwave radiation from the patch array 162 forward through the first reflector grid 130.

Figure 3B:
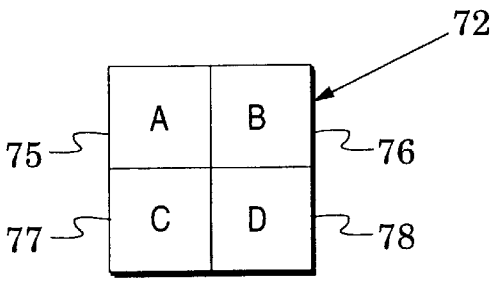
FIG. 3B (PRIOR ART)
FIG. 3B is a front view of the feed horns of FIG. 3A.
Figure 3A:
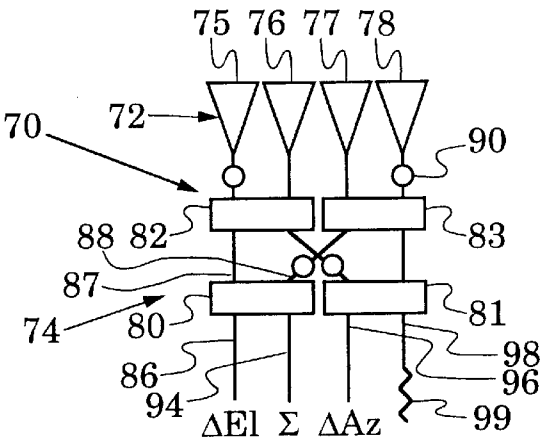
FIG. 3A (PRIOR ART)
FIG. 3A is a schematic of a tracking feed which includes some of the feed horns of FIG. 1A.
Figure 4C:
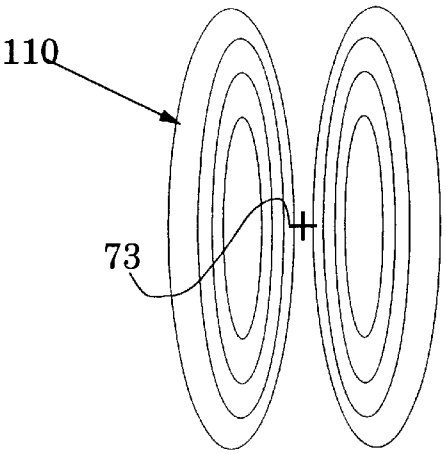
FIG. 4C (PRIOR ART)
FIGS. 4A, 4B and 4C are views respectively of a delta elevation radiation pattern, a sum radiation pattern and a delta azimuth radiation pattern which are generated by a tracking antenna that is formed with the tracking feed of FIG. 3A and the dual-gridded reflector of FIGS. 1A–D with the radiation patterns superimposed over a tracking station of FIG. 2.
Figure 4B:
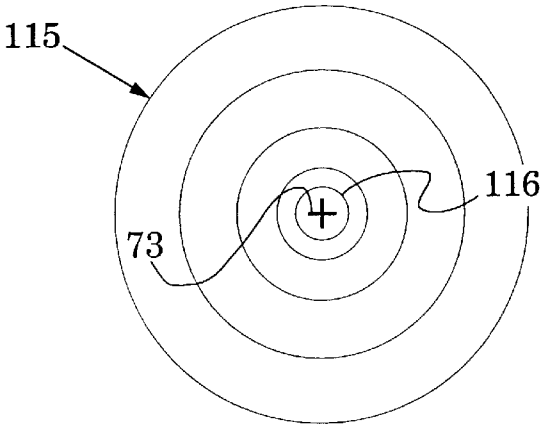
FIG. 4B (PRIOR ART)
Figure 4A:
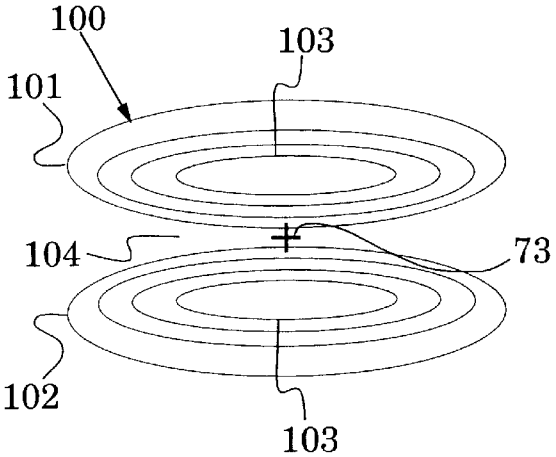
FIG. 4A (PRIOR ART)

Thus, the patch quadrants 166A–166D form four radiators which can be coupled together with a tracking transmission structure such as the tracking transmission structure 74 of FIG. 3A to generate a delta elevation radiation pattern, a delta azimuth radiation pattern and a sum radiation pattern similar to the patterns 100, 115 and 110 of FIGS. 4A–C. The radiation direction of these tracking patterns is indicated by the radiation arrow 180 in FIG. 6A.

In the antenna 100 of FIGS. 5A–C, the tracking radiation patterns are formed by radiation from the feed horn array 72 that reflects from a selected one of the first and second reflector grids 124 and 126. In contrast, tracking radiation patterns in the antenna system 160 are directly radiated from the embedded patch array 162 and are radiated through the first reflector grid 130 which is substantially transparent to this radiation because its grid lines 134 are orthogonal to the radiation's polarization.

The patch array 162 is embedded in the dual gridded reflector 122. Although it is shown spaced behind the second reflector grid 132, the patch array 162 is preferably embedded within the second reflector grid 132. More importantly, the patch array 162 is positioned so that the first reflector grid 130 lies between the patch array and the first and second feed horns 124 and 126. The first reflector grid 130 thus forms a filter which removes unwanted polarization components. As described below, this filtering acts to enhance the quality of both the tracking radiation 180 and the radiation 142 that is reflected from the second reflector grid 132.

Although the polarization of each patch 164 is aligned with the second reflector grid 132, the patch has appreciable width in the orthogonal direction of the first reflector grid 130. Therefore, circulating currents in the patch will generate some energy in the tracking radiation 180 that has an orthogonal polarization. However, this polarization is parallel with the first reflector grid 130 and it will be substantially filtered from the tracking radiation 180 by the first reflector grid.

The patch array 162 will reflect its portion of the radiation 142 from the second feed horn 126 primarily with the polarization of the radiation 142. Because of the ground current effect referred to above, the patch array 162 will also reflect some energy whose polarization is aligned with the first reflector grid 130. Again, this unwanted polarization will be substantially filtered from the radiation 142 as it passes through the first reflector grid 130.

Although it can be spaced on either side of the second reflector grid 132, the patch array 162 preferably lies in the contour of the second reflector grid, i.e., each patch 164 is substantially coplanar with its respective window 168. In this position, the patch can best fill in the shaped contour of the second reflector grid 132, and thus contribute properly phased radiation to the radiation 142. Also, each patch blocks less of the radiation of the second feed horn 126 from the second reflector grid 132 than if positioned, for example, between the first and second reflector grids 130 and 132.

Although the patch array 162 is exemplified in FIGS. 6B and 6D as containing sixteen patches, the beam width of the tracking radiation 180 can be adjusted by increasing or decreasing the number of patches 164 in the patch array. For example, a patch array which has only four patches (and therefore, one patch in each patch quadrant) will radiate a wider beam than the patch array 162.

Figure 8:
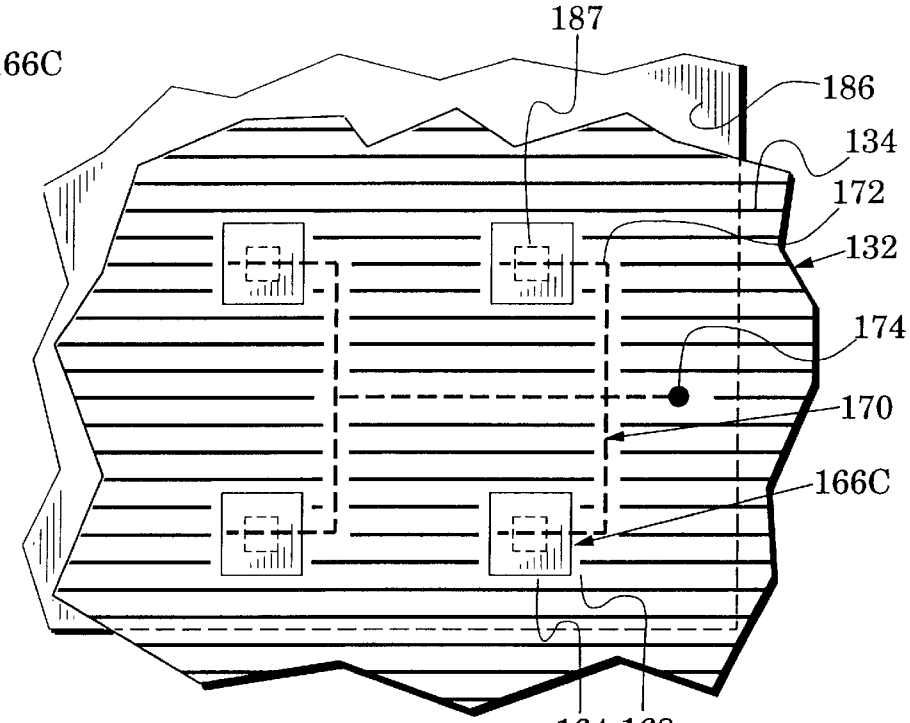
FIG. 8 is a view similar to FIG. 7, which shows another transmission line feed.

FIG. 8 is a view similar to FIG. 7, with like elements indicated by like reference numbers. FIG. 8 shows another structure for coupling energy to the patch array 162 with polarization that is aligned with the second reflector grid 132. In FIG. 8, the ground plane 176 is replaced by a ground plane 186 that forms a plurality of apertures 187. Each aperture 187 is positioned adjacent to a respective patch 164. In particular, each aperture 187 is positioned behind its respective patch 164 and is, accordingly, indicated in broken lines. The transmission line feed 170 of FIG. 7 is spaced behind the ground plane 186 so that microwave energy is coupled from the transmission line feed 170 through each aperture 187 to its respective patch 164.

Figure 9:
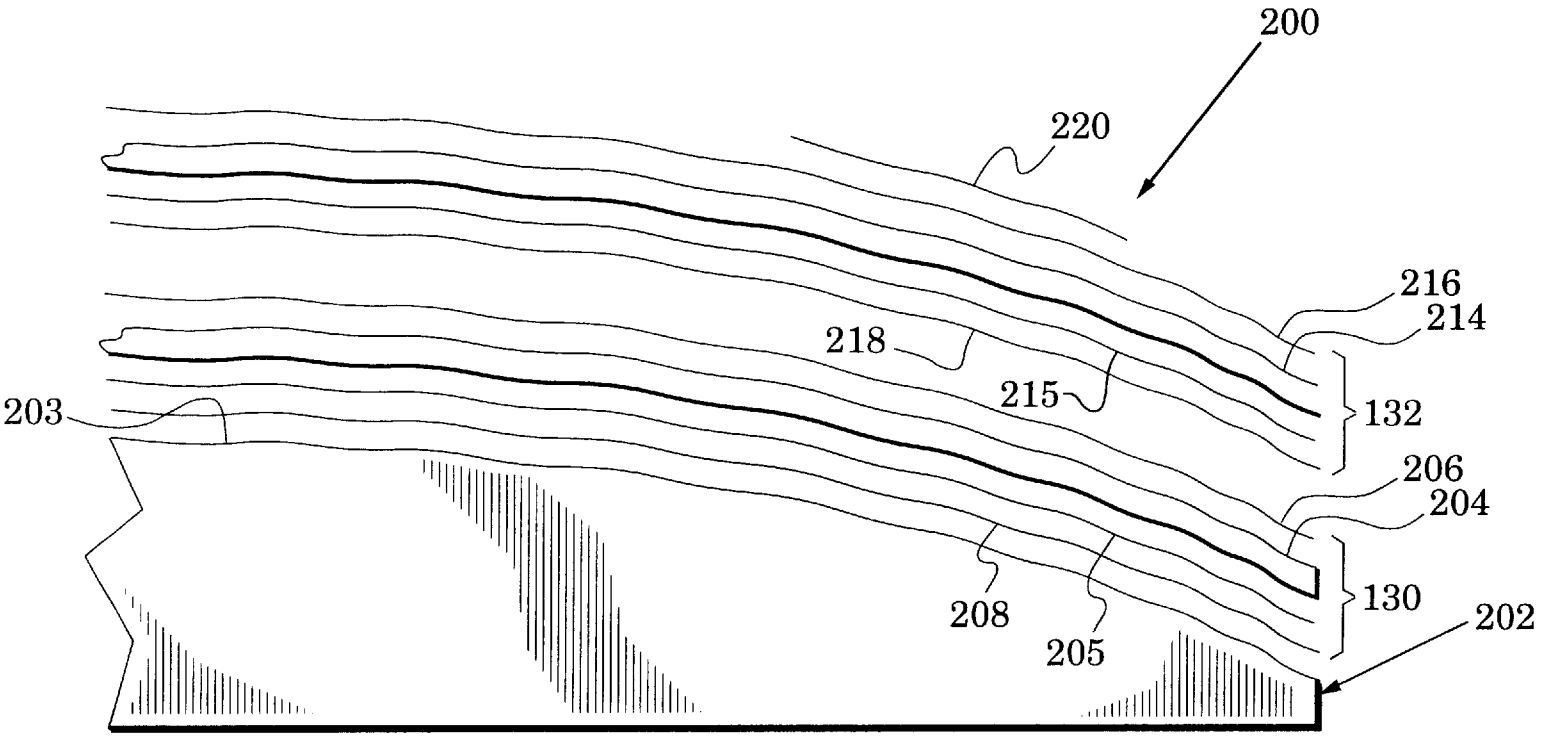
FIG. 9 illustrates an exemplary fabrication process.

FIG. 9 illustrates an exemplary fabrication structure and process 200 for the antenna system 160 of FIGS. 6A–6D and 7. A graphite mandrel 202 is formed with an upper surface 203 that defines the desired shape for the shaped dual gridded reflector 122.

A core 204 is provided that has a honeycomb configuration and is formed of sheets of fiber (e.g., as manufactured under the trademark Nomex by E. I. du Pont de Nemours & Company) in a phenolic resin matrix. Polyamide polymer faces 205 and 206 (e.g., as manufactured under the trademark Kevlar by E. I. du Pont de Nemours & Company) are positioned on either side of the core 204 to stiffen it. Reflector grid lines (134 in FIG. 6C) are deposited as a metal film (e.g., copper) onto a sheet 208 of a material which will adhere to the film (e.g., polyimide as manufactured under the trademark Kapton by E. I. du Pont de Nemours & Company) and this sheet is positioned between the face 206 and the mandrel 202.

The core 204, faces 205 and 206 and the sheet 208 will form the first reflector grid 130. A similar structure of a core 214, faces 215 and 216 and a sheet 218 are positioned to form the second reflector grid 132. The sheet 218 is printed with a metal film to form the second reflector grid 132 and the patch array 162 of FIGS. 6A–6D and the transmission line feeds 170 of FIG. 7. Finally, a polyimide sheet 220 is placed over the face 216 in the region of the patch array. The sheet 220 carries a full metal film to form the ground plane 176 of FIG. 7.

Heat, pressure and an adhesive, e.g., a thermosetting adhesive, are applied to cause the cores, faces and sheets to take on the shape of the mandrel surface 203 and to bond them permanently together. The tracking transmission structure 74 of FIG. 3A can be realized in various ways. For example, it can be printed as a microstrip circuit onto the sheet 216 along with the patch array (in this case, the microwave hybrids 80–83 would preferably be realized as directional couplers).

Figure 10:
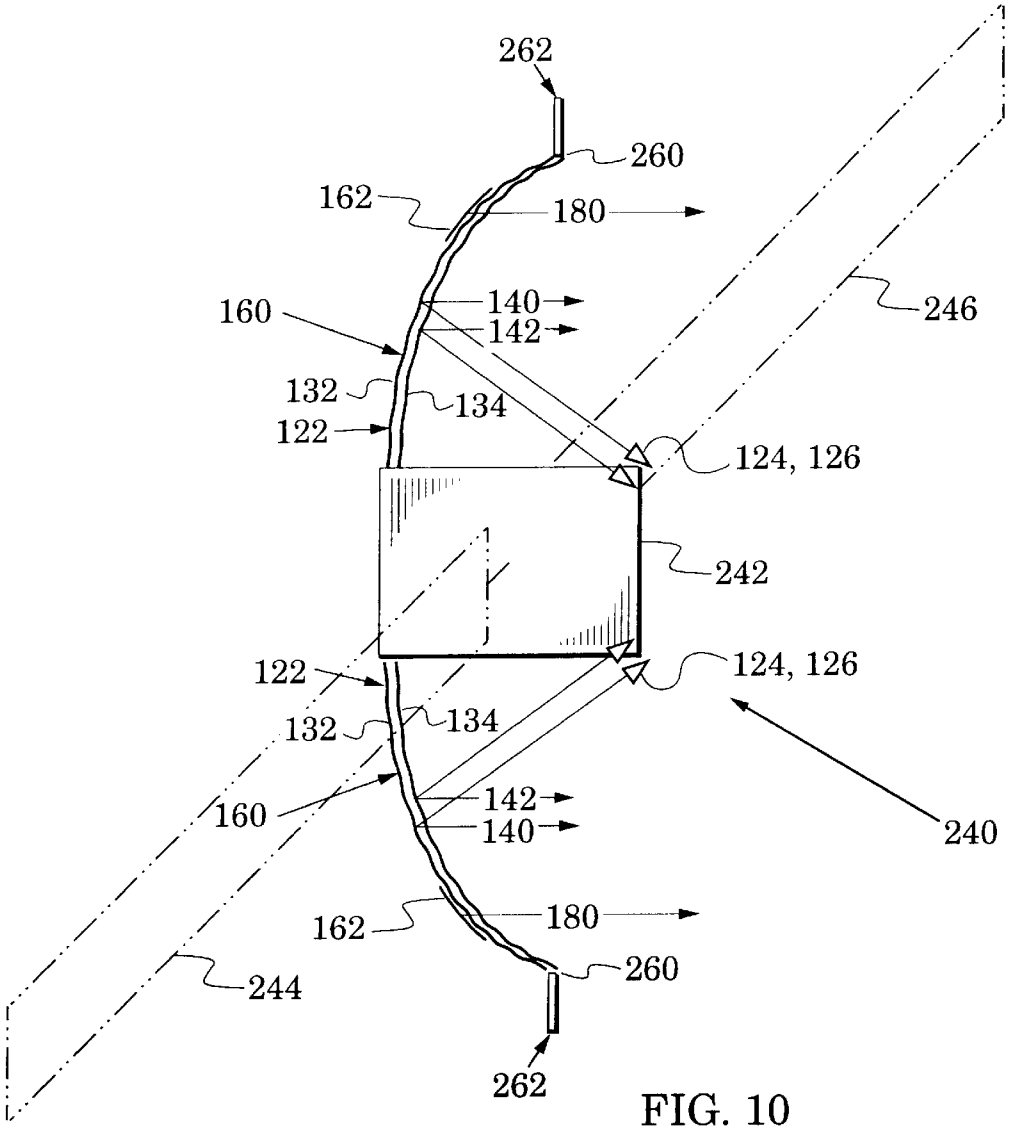
FIG. 10 is a perspective view that illustrates a communications satellite that carries a pair of the antenna system of FIGS. 6A–6D.

The antenna system 160 of FIGS. 6A–6D is especially suited for use in a satellite, e.g., the communications satellite 240 of FIG. 10. The satellite 240 includes a body 242 for carrying communications transmitters and receivers and a pair of solar wings 244 and 246 which generate electric power for the transmitters and receivers.

When installed in an orbit, e.g., a geosynchronous orbit, the satellite's solar wings are preferably rotatable so that solar cells in the wings 244 and 246 are positioned to face the sun. Antenna systems 160 are mounted to opposite sides of the body 242. The dual gridded reflectors 122 are preferably configured as off-axis parabolas so that the feed horns 124 and 126 (which are positioned near the antenna focus) do not intercept an appreciable portion of the antenna beams.

Each of the antenna systems 160 is movable relative to the body 242 and carries a patch array 162 (and other tracking antenna structure such as the ground plane 176 and transmission line feed 170 of FIG. 7 and tracking transmission structure 74 of FIG. 3A). The patch array's tracking radiation 180 (or, in accordance with antenna reciprocity, its receive signal) is used to point the dual gridded reflectors 122 so that their orthogonally polarized radiation 140 and 142 is directed to a predetermined footprint location on the Earth's surface. The patch array will typically not be orthogonal to the direction of its radiation 180. The direction of the radiation beam 180 can be adjusted by changing line lengths (and hence phasing) of the transmission line feed 170.

Figure 1C:
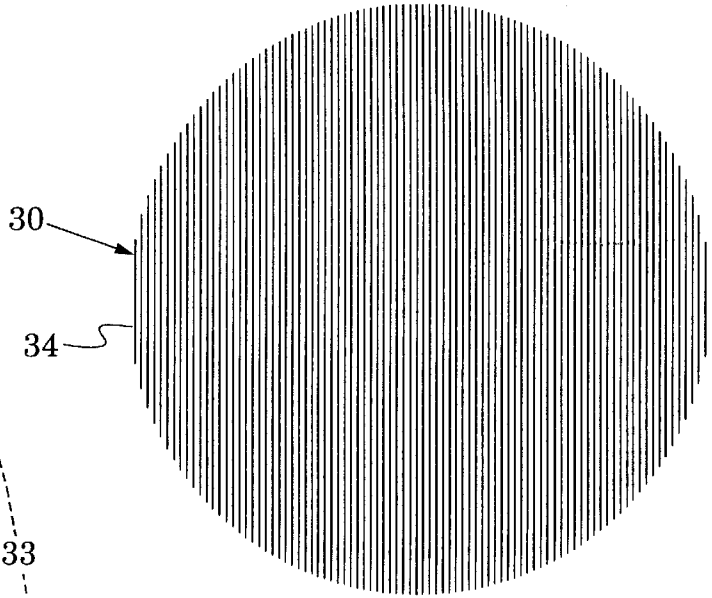
FIG. 1C (PRIOR ART)
FIG. 1C is a front view of the dual-gridded reflector of FIG. 1A.
Figure 1B:
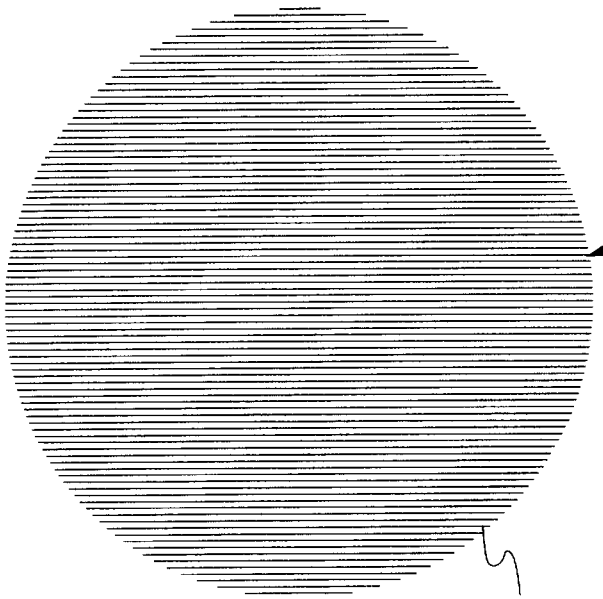
FIG. 1B (PRIOR ART)
FIG. 1B is a rear view of the dual-gridded reflector of FIG. 1A.
Figure 1A:
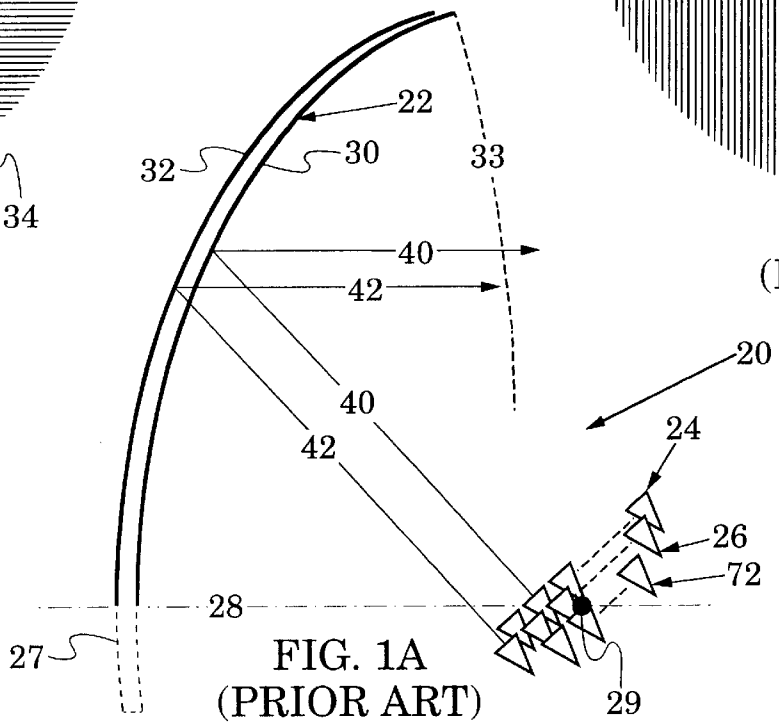
FIG. 1A (PRIOR ART)
FIG. 1A is a side view of a conventional communication antenna which includes a dual-gridded reflector and a plurality of feed horns.
Figure 1D:
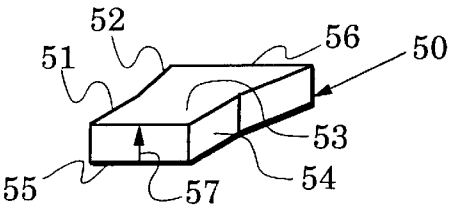
FIG. 1D (PRIOR ART)
FIG. 1D is a perspective view of a feed horn of FIG. 1A.
Figure 2:
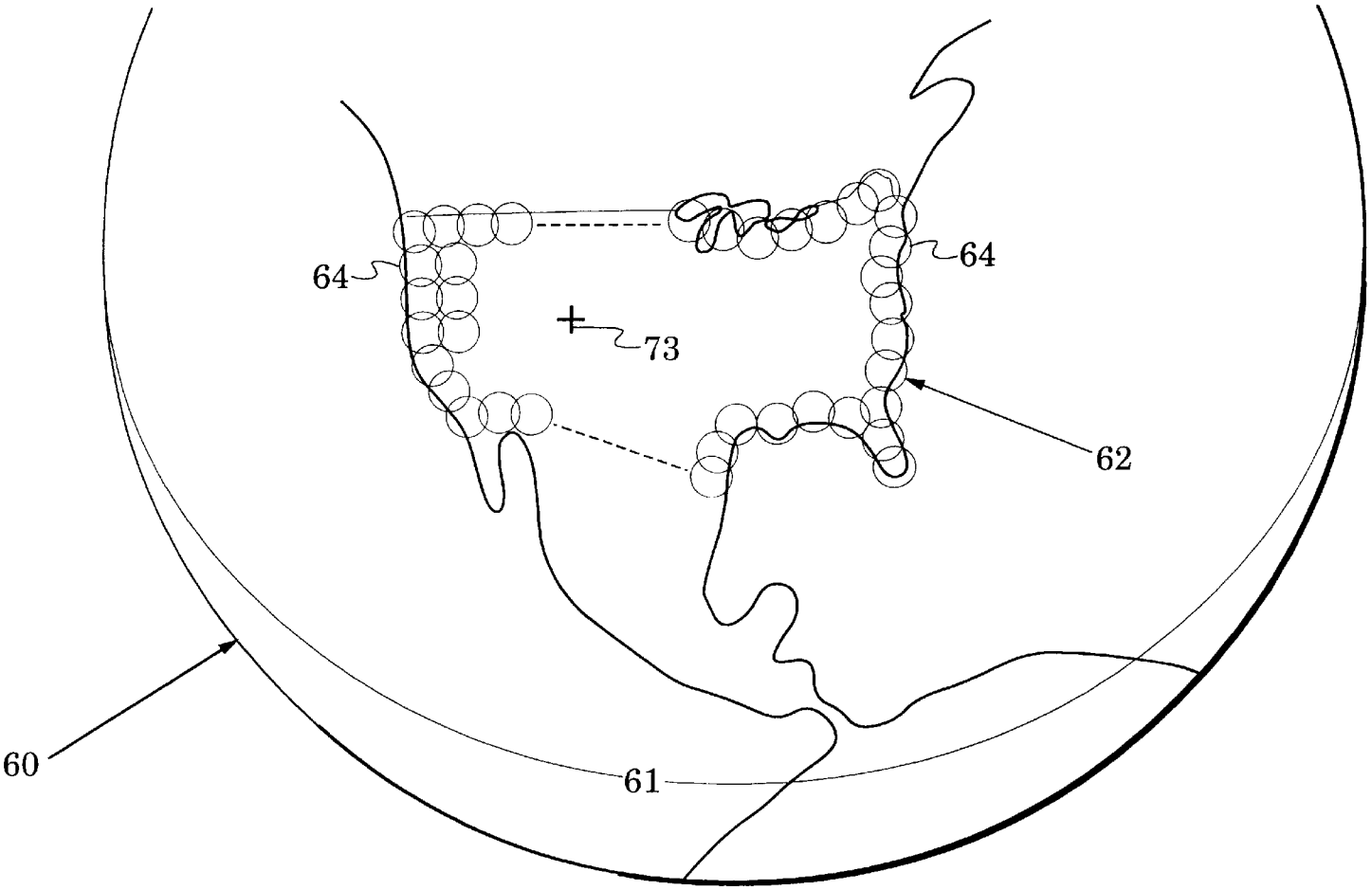
FIG. 2 (PRIOR ART)
FIG. 2 is view of the Earth which shows a radiation footprint that is generated by the antenna system of FIGS. 1A–D when it is carried on a geosynchronous satellite.

Although the patch array 162 is particularly suited for use with the shaped dual gridded reflector 122 of FIGS. 5A–5C, other useful antenna embodiments can be formed by embedding the array in other antenna structures, e.g., the dual gridded reflector 22 of FIGS. 1A–1C. Although the shaped dual gridded reflector 122 facilitates the transmission and reception of orthogonally polarized signals, other useful antenna embodiments can be formed by embedding the array 162 in a single gridded reflector, e.g., one formed by a selected one of the reflector grids 130 and 132 of FIGS. 5A–5C.

If the patch array 162 of FIG. 6A operates in the same frequency band as the shaped dual gridded reflector 122, the patch array will absorb some of the microwave energy 142 that is radiated by the feed horn 126. To improve efficiency, the first and second feed horns 124 and 126 and the shaped dual gridded reflector 122 on one hand and the patch array on the other hand are configured and dimensioned to radiate microwave energy in mutually exclusive frequency bands.

Although the patch array 162 has been shown embedded in the dual reflector grids 122, another antenna system embodiment may be formed by positioning the array 162 adjacent or adjoining the perimeter 260 of each dual reflector grid. This position is illustrated in FIG. 10 by the tracking arrays 262. In this position, the tracking arrays 262 can each be formed of a patch array (as shown in FIG. 6D), a horn array (as shown in FIGS. 3A and 3B) or any other array of radiating (or receiving) elements, e.g., dipoles or slots.

In this antenna system embodiment, the reflector may be the dual gridded reflector 22 of FIGS. 1A–1C, the shaped dual gridded reflector 122 of FIGS. 5A–5D or any conventional reflector. For example, another antenna system embodiment may be formed in FIG. 10 by a) removing the reflector 132 and its associated feed horn 126, b) assuming the reflector 130 and its associated feed horn 124 to be a solid or gridded reflector (shaped or unshaped) and associated feed horn, and c) positioning the tracking array 262 adjacent or adjoining the solid or gridded reflector as shown.

The tracking arrays 262 can each be coupled to a tracking transmission structure (similar to the tracking transmission structure 74 of FIG. 3A) which includes appropriate microwave transmission structures (e.g., coaxial lines or waveguides) and is positioned on the back of the respective one of the dual gridded reflectors 122.

As is well known, antennas have the property of reciprocity, i.e., the characteristics of a given antenna are the same whether it is transmitting or receiving. The use of descriptive terms, e.g., radiate, in the description and claims are for convenience and clarity of illustration and are not intended to limit the teachings of the invention. An antenna which can generate and radiate microwave signals and signal patterns can inherently receive the same signals and patterns.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An antenna system, comprising:

first and second feed horns;

a dual gridded reflector which includes first and second reflector grids that are arranged in a mutually orthogonal relationship, said dual gridded reflector positioned to reflect microwave energy from said first and second feed horns with said first reflector grid positioned between said second reflector grid and said first and second feed horns, wherein said first feed horn is configured to radiate a first microwave energy with a first polarization that is aligned with said first reflector grid and said second feed horn is configured to radiate a second microwave energy with a second polarization that is aligned with said second reflector grid; and a patch array which is positioned so that said first reflector grid is between said patch array and said first and second feed horns and which is configured to radiate a third microwave energy with a third polarization that is substantially aligned with said second polarization so that said third microwave energy passes through said first reflector grid.

2. The antenna system of claim 1, wherein:

said patch array includes a plurality of patches;

said second reflector grid forms a plurality of windows; and each of said patches is aligned with a respective one of said windows and said second feed horn.

3. The antenna system of claim 2, wherein each of said patches is substantially coplanar with its respective window.

4. The antenna system of claim 1, further including a ground plane positioned so that said patch array lies between said ground plane and said first reflector grid.

5. The antenna system of claim 1, wherein said patch array includes a plurality of patches and said patches are arranged in four patch quadrants, and further including four transmission line feeds which are each configured to connect with the patches of a respective one of said patch quadrants, each of said transmission line feeds arranged to couple microwave energy into its respective patch quadrant with a polarization that is substantially aligned with said second reflector grid.

6. The antenna system of claim 1, wherein said patch array includes a plurality of patches and said patches are arranged in four patch quadrants, and further including:

a ground plane positioned so that said patch array lies between said ground plane and said first reflector grid, said ground plane forming a plurality of apertures which are each positioned adjacent to a respective one of said patches; and four transmission line feeds which are each configured to couple to the patches of a respective one of of said patch quadrants, each of said transmission line feeds arranged and positioned to couple microwave energy to each of its respective patches through a respective one of said apertures and with a polarization that is substantially aligned with said second reflector grid.

7. The antenna system of claim 1, wherein said patch array includes a plurality of patches and said patches are arranged in four patch quadrants, and further including a tracking transmission structure which is coupled to said patch quadrants and is configured to connect microwave energy to said patch quadrants to generate a pair of mutually orthogonal delta radiation patterns and a sum radiation pattern.

8. The antenna system of claim 1, wherein said dual gridded reflector and said first and second feed horns are configured to operate in a first frequency band, and said patch array is configured to radiate microwave energy in a second frequency band wherein said first and second frequency bands are mutually exclusive.

9. The antenna system of claim 1, wherein each of said patches has a rectangular shape.

10. The antenna system of claim 1, wherein said dual gridded reflector substantially has the form of a parabola which has an axis and a focus on said axis, and said first and second feed horns are positioned substantially at said focus.

11. The antenna system of claim 10, wherein said dual gridded reflector has the form of an off-axis segment of said parabola.

12. The antenna system of claim 10, wherein said dual gridded reflector is shaped to have dimensional deviations from said parabola to obtain predetermined phase variations in the microwave energy reflected from said dual gridded reflector.

13. The antenna system of claim 1, wherein said patch array includes:

a plurality of patches; and a plurality of transmission feed lines which are each coupled to a respective one of said patches and arranged with that patch to generate microwave energy with said third polarization.

14. A satellite communication system, comprising:

a satellite; and an antenna system carried on said satellite, said antenna system having:

a) first and second feed horns;

b) a dual gridded reflector which includes first and second reflector grids that are arranged in a mutually orthogonal relationship, said dual gridded reflector positioned to reflect microwave energy from said first and second feed horns with said first reflector grid positioned between said second reflector grid and said first and second feed horns, wherein said first feed horn is configured to radiate a first microwave energy with a first polarization that is aligned with said first reflector grid and said second feed horn is configured to radiate a second microwave energy with a second polarization that is aligned with said second reflector grid; and c) a patch array which is positioned so that said first reflector grid is between said patch array and said first and second feed horns and which is configured to radiate a third microwave energy with a third polarization that is substantially aligned with said second polarization so that said third microwave energy passes through said first reflector grid.

15. The satellite communication system of claim 14, wherein:

said patch array includes a plurality of patches;

said second reflector grid forms a plurality of windows; and each of said patches is aligned with a respective one of said windows and said second feed horn.

16. The satellite communication system of claim 15, wherein each of said patches is substantially coplanar with its respective window.

17. The satellite communication system of claim 14, further including a ground plane positioned so that said patch array lies between said ground plane and said first reflector grid.

18. The satellite communication system of claim 14, wherein said patch array includes a plurality of patches and said patches are arranged in four patch quadrants, and further including four transmission line feeds which are each configured to connect with the patches of a respective one of said patch quadrants, each of said transmission line feeds arranged to couple microwave energy into its respective patch quadrant with a polarization that is substantially aligned with said second reflector grid.

19. The satellite communication system of claim 14, wherein said patch array includes a plurality of patches and said patches are arranged in four patch quadrants, and further including:

a ground plane positioned so that said patch array lies between said ground plane and said first reflector grid, said ground plane forming a plurality of apertures which are each positioned adjacent to a respective one of said patches; and four transmission line feeds which are each configured to couple to the patches of a respective one of of said patch quadrants, each of said transmission line feeds arranged and positioned to couple microwave energy to each of its respective patches through a respective one of said apertures and with a polarization that is substantially aligned with said second reflector grid.

20. The satellite communication system of claim 14, wherein said patch array includes a plurality of patches and said patches are arranged in four patch quadrants, and further including a tracking transmission structure which is coupled to said patch quadrants and is configured to connect microwave energy to said patch quadrants to generate a pair of mutually orthogonal delta radiation patterns and a sum radiation pattern.

21. The satellite communication system of claim 20, further including an earthbound tracking station configured to transmit a tracking signal to said patch array for the generation of tracking control signals that facilitate steering of said antenna system.

22. The antenna system of claim 14, wherein said dual gridded reflector and said first and second feed horns are configured to operate in a first frequency band, and said patch array is configured to radiate microwave energy in a second frequency band wherein said first and second frequency bands are mutually exclusive.

23. The satellite communication system of claim 14, wherein each of said patches has a rectangular shape.

24. The satellite communication system of claim 14, wherein said dual gridded reflector substantially has the form of a parabola which has an axis and a focus on said axis and said first and second feed horns are positioned substantially at said focus.

25. The satellite communication system of claim 24, wherein said dual gridded reflector has the form of an off-axis segment of said parabola.

26. The satellite communication system of claim 24, wherein said dual gridded reflector is shaped to have dimensional deviations from said parabola to obtain predetermined phase variations in the microwave energy reflected from said dual gridded reflector.

27. The antenna system of claim 14, wherein said patch array includes:

a plurality of patches; and a plurality of transmission feed lines which are each coupled to a respective one of said patches and arranged with that patch to generate microwave energy with said third polarization.

28. An antenna system, comprising:

a feed horn;

a gridded reflector which includes a reflector grid and which is positioned to reflect microwave energy from said feed horn wherein said feed horn is configured to radiate microwave energy with a first polarization that is aligned with said reflector grid, said reflector grid forming a plurality of windows; and a patch array having a plurality of patches which are each aligned with a respective one of said windows, said patch array configured to radiate microwave energy with a second polarization that is substantially aligned with said first polarization.

29. The antenna system of claim 28, wherein each of said patches is substantially coplanar with its respective window.

30. The antenna system of claim 28, further including a ground plane spaced from said patch array.

31. The antenna system of claim 28, wherein said patches are arranged in four patch quadrants, and further including four transmission line feeds which are each configured to connect with the patches of a respective one of said patch quadrants, each of said transmission line feeds arranged to couple microwave energy into its respective patch quadrant with a polarization that is substantially aligned with said reflector grid.

32. The antenna system of claim 28, wherein said patches are arranged in four patch quadrants, and further including:

a ground plane spaced from said patch array with said ground plane forming a plurality of apertures; and four transmission line feeds which are each configured to couple to the patches of a respective one of of said patch quadrants, each of said transmission line feeds arranged and positioned to couple microwave energy to each of its respective patches through a respective one of said apertures and with a polarization that is substantially aligned with said reflector grid.

33. The antenna system of claim 28, wherein said patches are arranged in four patch quadrants, and further including a tracking transmission structure which is coupled to said patch quadrants and is configured to connect microwave energy to said patch quadrants to generate a pair of mutually orthogonal delta radiation patterns and a sum radiation pattern.

34. The antenna system of claim 28, wherein said patch array includes:

a plurality of patches; and a plurality of transmission feed lines which are each coupled to a respective one of said patches and arranged with that patch to generate microwave energy with said second polarization.

35. An antenna system, comprising:

first and second feed horns;

a dual gridded reflector having a perimeter and having first and second reflector grids that are arranged in a mutually orthogonal relationship and said dual gridded reflector is positioned to reflect microwave energy from said first and second feed horns with said first reflector grid positioned between said second reflector grid and said first and second feed horns, wherein said first feed horn is configured to radiate microwave energy with a polarization that is aligned with said first reflector grid and said second feed horn is configured to radiate microwave energy with a polarization that is aligned with said second reflector grid; and a patch array positioned adjoining said perimeter, said patch array having a plurality of patches arranged in four patch quadrants and having four transmission line feeds which each couple to a respective one of said patch quadrants.

36. The antenna system of claim 35, further including a tracking transmission structure which is coupled to said transmission line feeds and is configured to direct microwave energy to said patch quadrants to generate a pair of mutually orthogonal delta radiation patterns and a sum radiation pattern.

* * * * *